US006655966B2

(12) United States Patent
Rothermel et al.

(10) Patent No.: US 6,655,966 B2
(45) Date of Patent: Dec. 2, 2003

(54) MODULAR CONNECTOR WITH GROUNDING INTERCONNECT

(75) Inventors: Brent Ryan Rothermel, Harrisburg, PA (US); Michael J. Phillips, Camp Hill, PA (US); Alex Michael Sharf, Harrisburg, PA (US); David Wayne Helster, Harrisburg, PA (US); Randall Robert Henry, Harrisburg, PA (US); James Lee Fedder, Etters, PA (US); Lynn Robert Sipe, Mifflintown, PA (US); David Keay Fowler, Boiling Springs, PA (US); Attalee S. Taylor, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/100,822

(22) Filed: Mar. 19, 2002

(65) Prior Publication Data

US 2003/0181077 A1 Sep. 25, 2003

(51) Int. Cl.[7] ..... H01R 12/04
(52) U.S. Cl. ..... 439/76.1; 439/79
(58) Field of Search ..... 439/76.1, 607, 439/608, 79

(56) References Cited

U.S. PATENT DOCUMENTS

| | | | | | |
|---|---|---|---|---|---|
| 6,083,047 | A | * | 7/2000 | Paagman | 439/608 |
| 6,146,202 | A | * | 11/2000 | Ramey et al. | 439/608 |
| 6,171,115 | B1 | * | 1/2001 | Mickievicz et al. | 439/76.1 |
| 6,174,202 | B1 | * | 1/2001 | Mitra | 439/608 |
| 6,267,604 | B1 | | 7/2001 | Mickievicz et al. | 439/79 |
| 6,343,955 | B2 | | 2/2002 | Billman et al. | 439/608 |
| 6,506,076 | B2 | * | 1/2003 | Cohen et al. | 439/608 |
| 6,520,803 | B1 | * | 2/2003 | Dunn | 439/608 |

* cited by examiner

*Primary Examiner*—Tulsidas Patel

(57) ABSTRACT

An electrical connector is provided having a connector housing with signal modules and grounding members therein. Each of the signal modules has a ground plane on at least one side of each of the signal modules. The ground planes have contact pads formed at opposite ends thereof proximate mating ends of the signal modules. The grounding members interconnect the ground planes on the sides of adjacent signal modules to one another at a point along one of the ground planes and the contact pads. Optionally, the signal modules may include vias having conductive liners therethrough that electrically connect ground planes from opposite sides of a signal module to one another. Alternatively, the signal modules can be printed circuit boards. The signal modules may be arranged parallel to one another within the housing.

20 Claims, 15 Drawing Sheets

200
208
204
206
202
210
211
212
214
216
218
207

MODULAR CONNECTOR WITH GROUNDING INTERCONNECT

BACKGROUND OF THE INVENTION

Certain embodiments of the present invention generally relate to electrical connectors, and more particularly to high-speed high-density board-to-board connectors.

Modular connectors exist for connecting various types of circuit boards, such as daughter cards, mother boards, back planes and the like. The modular connectors convey a densely packed number of signal lines between the circuit boards. The modular connectors each include multiple wafers or signal modules stacked in parallel. The wafers have two sides that have ground planes and signal lines formed thereon. The signal lines carry data between mating ends of the wafers, and the ground planes control impedance. The signal lines may be arranged on adjacent wafers to form differential pairs. In differential pair applications, a signal is divided and transmitted in a first direction over a pair of conductors (and hence through a pair of pins or contacts). A return signal is similarly divided and transmitted in an opposite direction over the same pair of conductors (and hence through the same pair of pins or contacts). For example, two signal lines on adjacent wafers may form a differential pair and carry a divided signal along the two signal lines.

There is a trend in board-to-board connectors toward increased data rates and line densities. Line density is a measure of differential pairs per linear inch measured along the direction perpendicular to the wafers. Generally, increasing the data rates and line density increases insertion loss and cross talk between signal lines. Ground planes reduce interference between signal lines and therefore decrease insertion loss and cross talk.

However, existing modular connectors have experienced difficulty in conveying extremely high speed data signals without severely attenuating the output signal. In particular, as data rates rise into the giga-hertz range, the signals output by the modular connectors are increasingly attenuated, such as by over 1 dB. This attenuation is also referred to as insertion loss. Attenuation is due in part to the fact that the ground planes within the connector housing develop local potentials with respect to one another during use. The buildup of the potentials between the ground planes causes the ground planes to resonate at certain frequencies, resulting in degraded throughput signals (insertion loss) and increased cross talk between signal lines on the wafers.

A need remains for an improved connector that can more adequately handle high-speed high-density data rates.

BRIEF SUMMARY OF THE INVENTION

An embodiment of the present invention provides an electrical connector having a connector housing with signal modules and grounding members therein. Each signal module has a ground plane on at least one side thereof. The ground planes have contact pads formed at opposite ends thereof proximate mating ends of the signal modules. The grounding members interconnect the ground planes on adjacent signal modules to one another at a point along the ground planes or the contact pads. Optionally, the signal modules may be printed circuit boards. Alternatively, the signal modules may be pieces of molded plastic with metal traces mounted thereon.

Optionally, the signal modules may include vias having conductive liners therethrough that electrically connect ground planes on opposite sides of a signal module. The signal modules may be arranged parallel to one another within the housing. Each signal module may have one or more ground planes and one or more signal lines. Optionally, adjacent signal modules may have signal lines facing one another and forming differential pairs.

The grounding member may include pins adjoining two or more vias on two or more signal modules to one another. Alternatively, the grounding member may be a conductive rod that extends through a plurality of vias in a plurality of signal modules. The grounding member may be a metal object interposed between adjacent signal modules and may have one of spring members, dimples and beams that contact ground planes on the adjacent modules. Alternatively, the grounding member may be a metal rack having slots cut therein for receiving signal modules, where the signal modules include projections contacting ground planes on the signal modules.

An advantage of certain embodiments of the present invention is that the connector can carry large amounts of data quickly and in a very high line density with reduced insertion loss and cross talk. Because the ground planes are electrically interconnected within the connector housing by the conductive liners of the vias and the grounding members, the development of local potentials on the ground planes is minimized, thereby reducing insertion loss rates and cross talk between signal lines.

Figure 1:
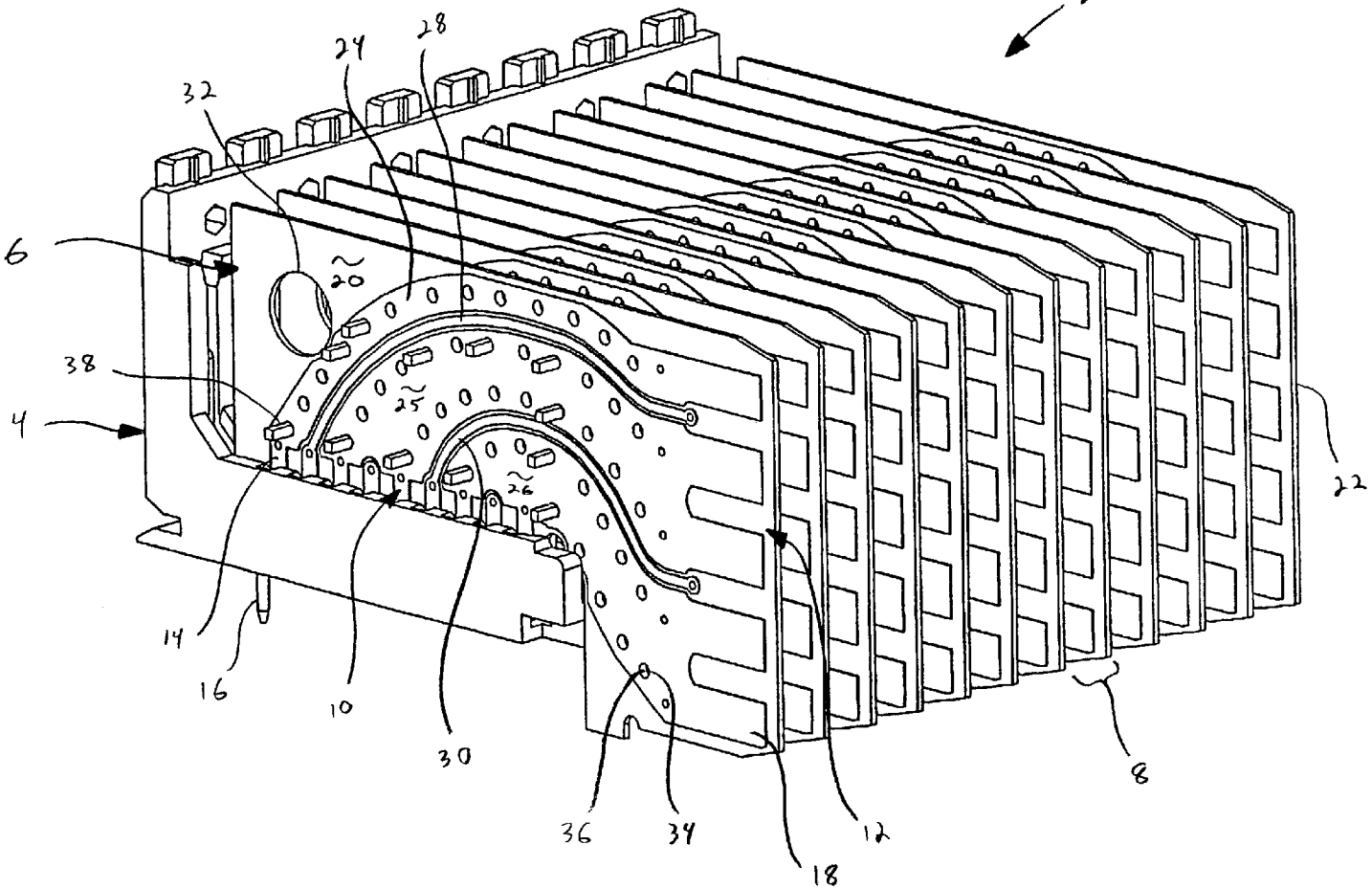
FIG. 1 illustrates a top front perspective view of a connector assembly formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a plug 2 formed in accordance with an embodiment of the present invention. The plug 2 is configured to mate with a receptacle (not shown) to form a right angle connector assembly (not shown). The plug 2 includes a connector housing 4 and a plurality of signal modules 6 mounted therein. The signal modules 6 are arranged parallel to one another and spaced apart by gaps 8. The signal modules 6 include mating ends 10 and 12 formed at right angles to one another. The mating end 10 includes pads 14 for mating with a contact (not visible) that has a pin 16 extending downward therefrom. The pin 16 is configured to be inserted into a via in a daughter printed circuit board (PCB) (not shown). The mating end 12 includes pads 18 that are configured to mate with a back plane PCB (not shown). The signal modules include side surfaces 20 and 22 that have ground planes 24 and signal lines 28. For example, each of the signal modules 6 includes six ground planes 24 and four signal lines 28.

Each of the signal modules 6 also includes a drill hole 32 for location purposes during manufacturing and a plurality of holes or vias 34. The vias 34 include conductive liners 36 that electrically connect the ground planes 24 on the side surfaces 20 and 22 of each signal module 6 to one another. In the embodiment of FIG. 1, grounding rods 38 are inserted through selected vias 34 in at least two signal modules 6. The grounding rods 38 electrically inter-connect the ground planes 24 of different signal modules 6 to one another.

Figure 2:
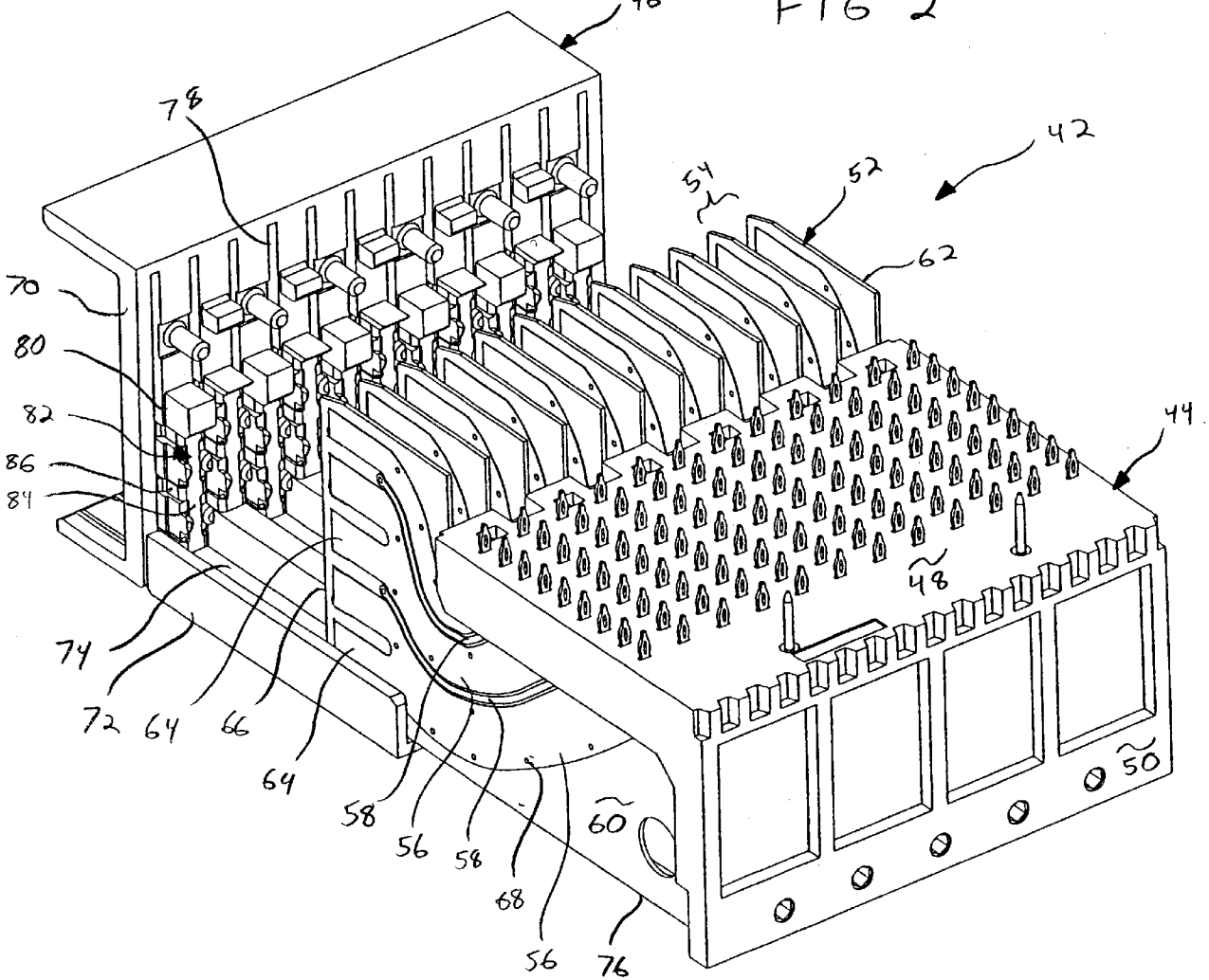
FIG. 2 illustrates a bottom rear perspective view of a connector assembly formed in accordance with an alternative embodiment of the present invention.

FIG. 2 illustrates a plug 42 formed in accordance with an alternative embodiment of the present invention. The plug 42 includes connector housings 44 and 46 (unmated in FIG. 2). The connector housing 44 includes top and rear walls 48 and 50 that hold a plurality of signal modules 52 arranged parallel to one another and spaced apart at gaps 54. The signal modules 52 include ground planes 56 and signal lines 58 arranged on both sides 60, 62 of the signal modules 52. The ground planes 56 include pads 64 that are located proximate mating ends 66 of the signal modules 52. The signal modules 52 also include vias 68 having conductive liners therethrough that electrically connect the ground planes 56 on opposite sides 60 and 62 of the signal modules 52 to one another.

The connector housing 46 includes front and bottom walls 70 and 72 that join with the top and rear walls 48 and 50. The bottom wall 72 includes channels 74 extending along a length thereof for receiving bottom edges 76 of the signal modules 52. The front wall 70 includes slots 78 for receiving mating ends 66 of the signal modules 52.

The front wall 70 includes plastic rails 80 located between, and along, the slots 78 and having contact brackets 82 clasped thereto. The contact brackets 82 include a flat body section 84 having flat legs 86 that clasp the rails 80. When the connector housings 44 and 46 are mated, the slots 78 receive the mating ends 66 of the signal modules 52, and the flat legs 86 of the contact brackets 82 engage the ground planes 56. For example, when the connector housings 44 and 46 are mated, each of the contact brackets 82 is electrically connected to the ground planes 56 of two adjacent of the signal modules 52.

Figure 3:
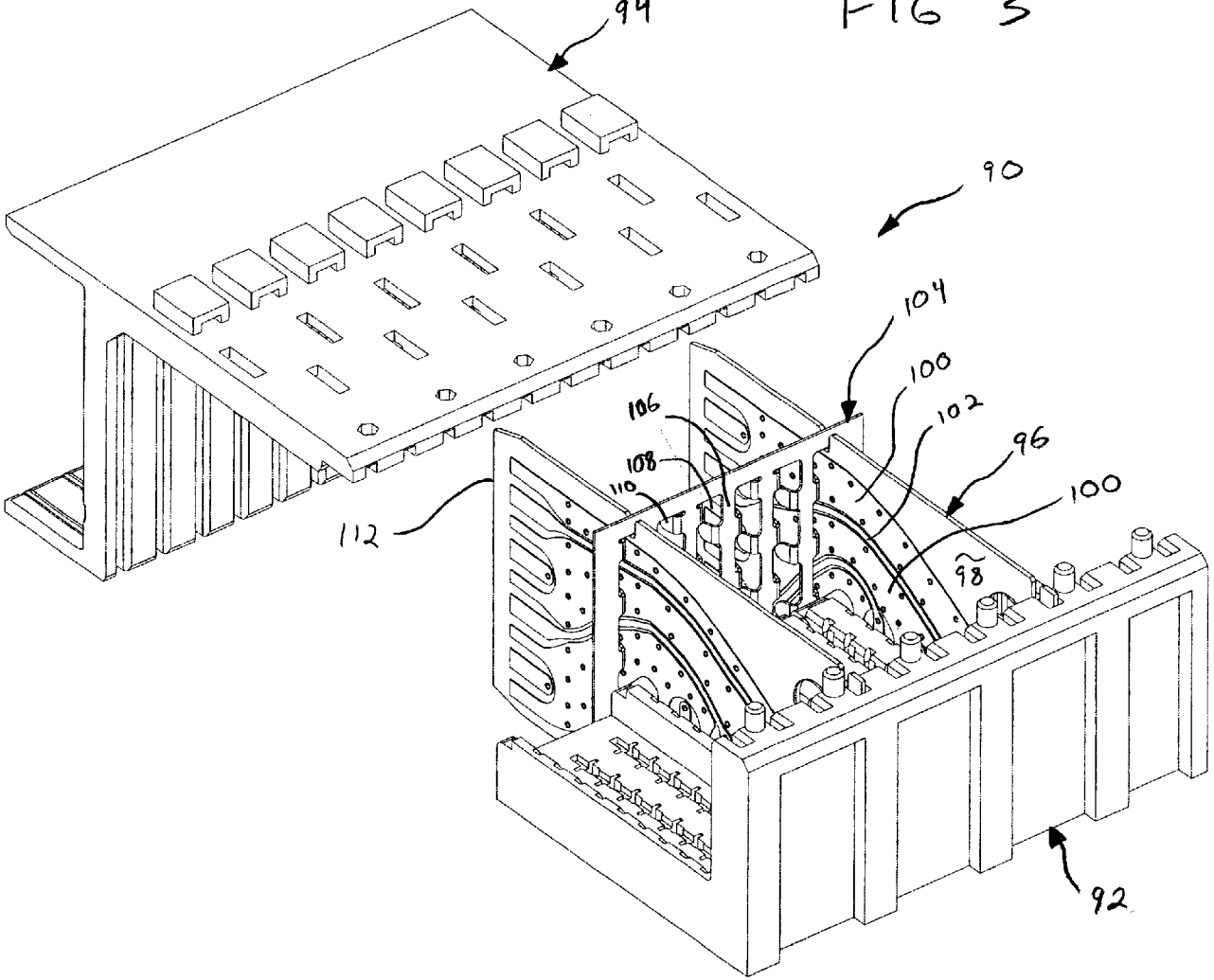
FIG. 3 illustrates a top rear perspective view of a connector assembly formed in accordance with an alternative embodiment of the present invention.

FIG. 3 illustrates a plug 90 formed in accordance with an alternative embodiment of the present invention. The plug 90 includes connector housings 92 and 94. The connector housing 92 includes signal modules 96 therein. The signal modules 96 include side surfaces 98 having ground planes 100 and signal lines 102 formed thereon. The signal modules 96 are held within a conductive plate 104 having flat parallel bars 106 separated by parallel slots 108 cut therebetween. The slots 108 receive the signal modules 96 so that the planes of the signal modules 96 are perpendicular to the plane of the conductive plate 104. The bars 106 include compliant fingers 110 extending horizontally therefrom and bending towards mating ends 112 of the signal modules 96. The compliant fingers 110 engage, and electrically interconnect, the ground planes 100 of the signal modules 96. Thus all of the ground planes 100 are electrically connected to one another.

Figure 4:
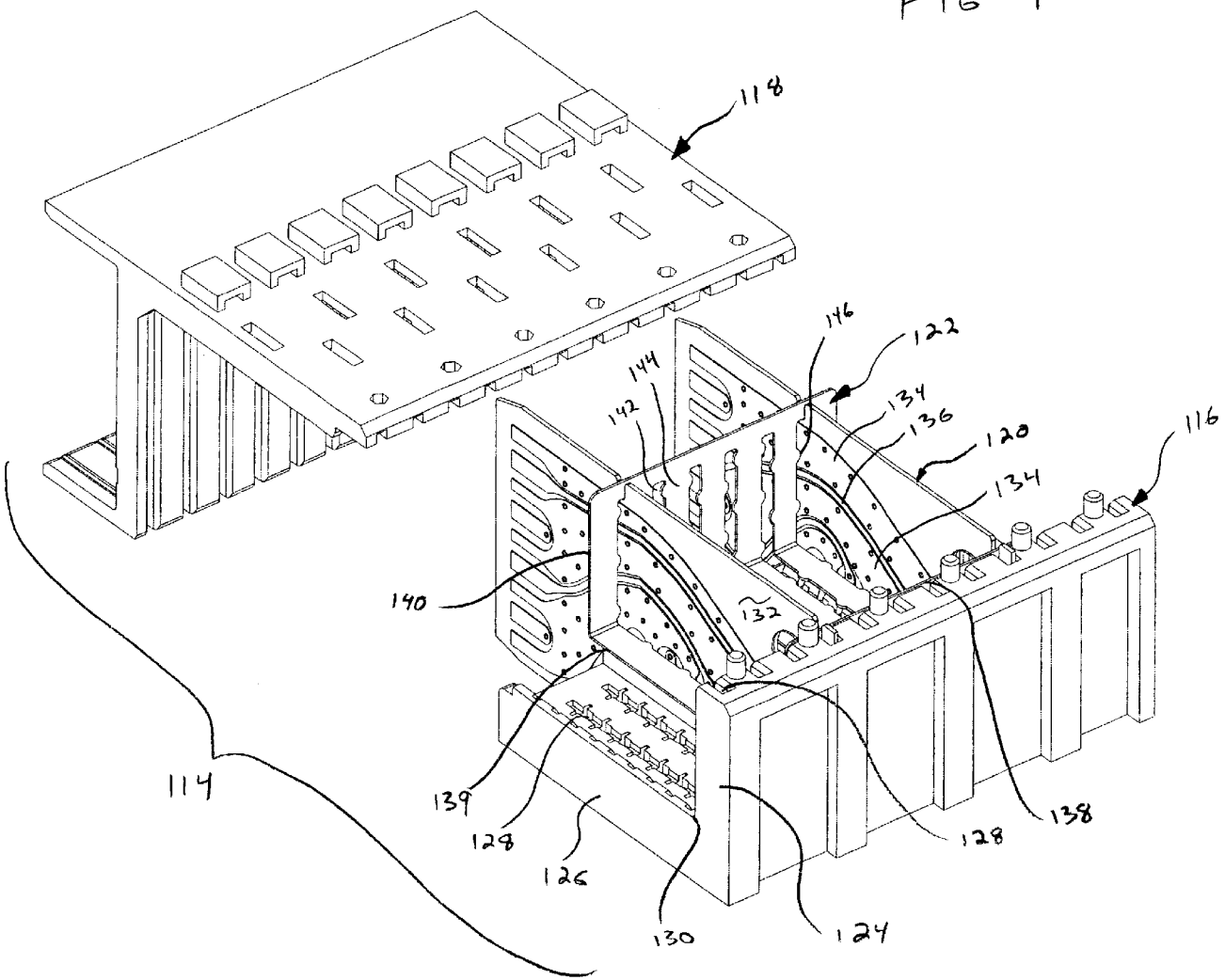
FIG. 4 illustrates a top rear perspective view of a connector assembly formed in accordance with an alternative embodiment of the present invention.

FIG. 4 illustrates a plug 114 formed in accordance with an alternative embodiment of the present invention. The plug 114 includes connector housings 116 and 118. The connector housing 116 includes signal modules 120 and a U-shaped grounding jacket 122 therein. The connector housing 116 includes front and bottom walls 124 and 126 that are aligned perpendicular to one another. The front and bottom walls 124 and 126 include L-shaped channels 128 (only partially visible) for receiving the signal modules 120. The channels 128 turn 90 degrees at a juncture 130 between the front and bottom walls 124 and 126. The signal modules 120 include side surfaces 132 having ground planes 134 and signal lines 136 formed thereon. The grounding jacket 122 includes front and back walls 138 and 140 that are aligned parallel to one another and spaced apart. The front and back walls 138 and 140 are joined together by a bottom wall 139. The walls 138–140 include parallel slots 142 cut therethrough and spaced apart by flat bars 144. The slots 142 are aligned with the channels 128 and receive the signal modules 120. The flat bars 144 include semicircular projections 146 protruding into the slots 142 and engaging, and electrically interconnecting, the ground planes 134 on the signal modules 120.

Figure 5:
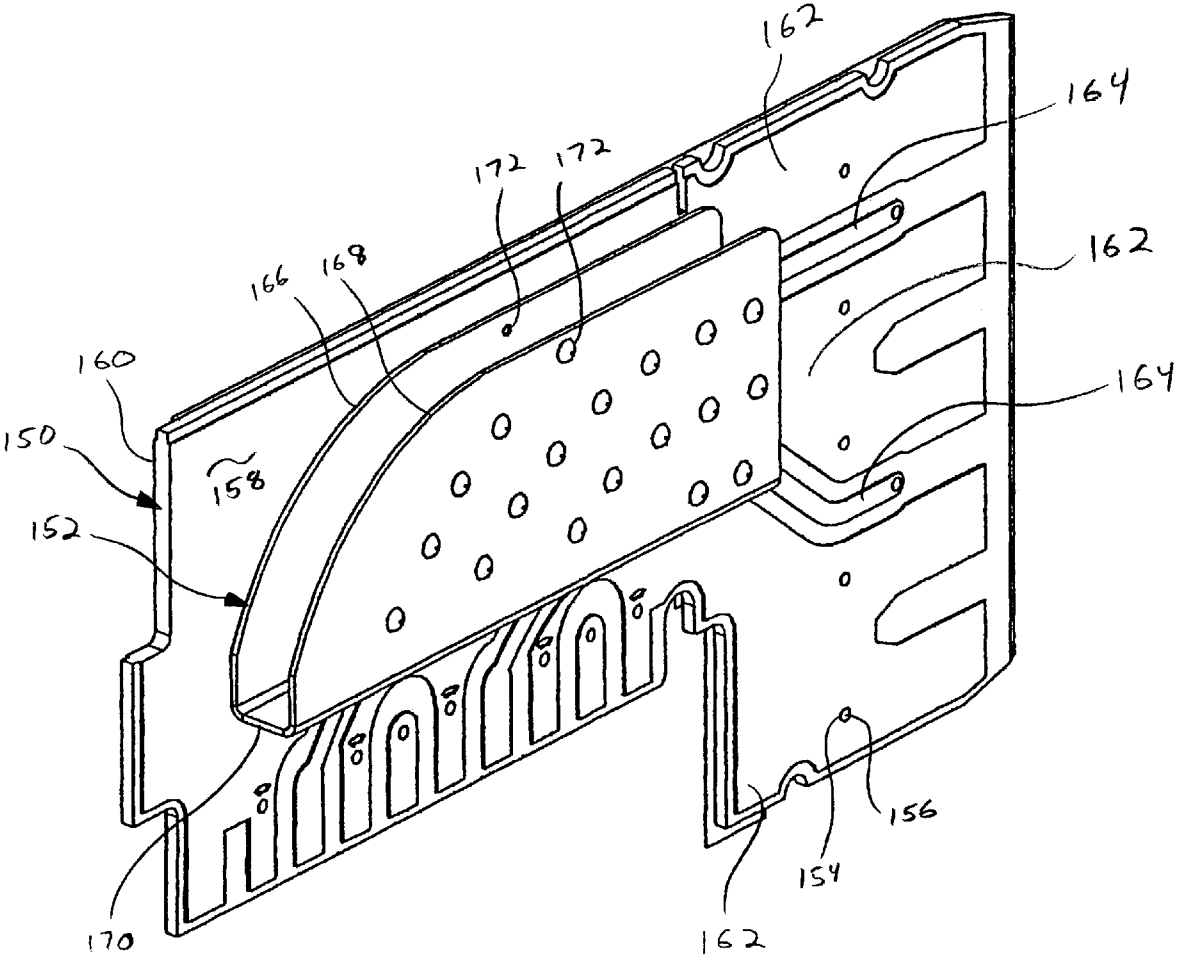
FIG. 5 illustrates a top rear perspective view of a signal module and a grounding bracket formed in accordance with an embodiment of the present invention.

FIG. 5 illustrates a signal module 150 adjacent to and engaged with a U-shaped grounding bracket 152 formed in accordance with an embodiment of the present invention. The signal module 150 includes vias 154 having conductive liners 156 therethrough. The signal module 150 also includes side surfaces 158, 160 having ground planes 162 and signal lines 164 formed thereon. The grounding bracket 152 includes planar sidewalls 166 and 168 aligned parallel to, and separated from, one another, and joined by a bottom wall 170. The sidewalls 166 and 168 include extruded dimples 172 protruding outward in a direction perpendicular to, and away from, both of the sidewalls 166 and 168. The dimples 172 engage the ground planes 162 of the signal module 150, thereby electrically interconnecting the ground planes 162 on the side surface 158.

The ground planes 162 on the side surface 160 (not visible) are electrically connected to the ground planes 162 on the side surface 158 through the conductive liners 156 of the vias 154. Thus, all of the ground planes 162 of the signal module 150 are electrically connected to one another. Alternatively, the signal module 150 and grounding bracket 152 can be stacked into a connector housing (not shown) in an alternating arrangement of signal modules 150 and metal brackets 152 so that all of the ground planes 162 of several signal modules 150 are electrically interconnected with one another. In such an arrangement, friction between the dimples 172 and the ground planes 162 retains the metal brackets 152 in position.

Figure 6:
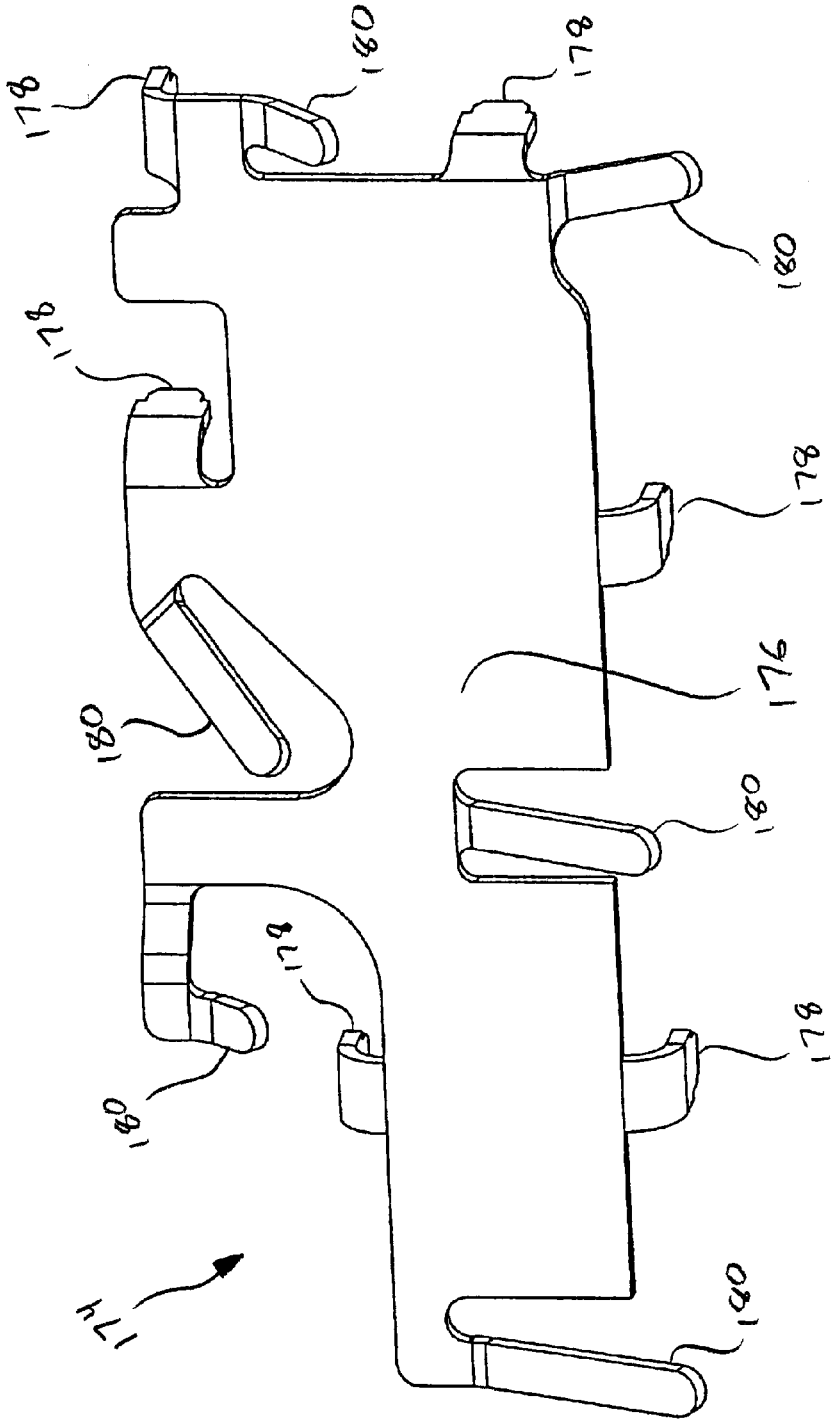
FIG. 6 illustrates a bottom front perspective view of a grounding plate formed in accordance with an embodiment of the present invention.

FIG. 6 illustrates a grounding plate 174 formed in accordance with an embodiment of the present invention. The grounding plate 174 is for insertion between parallel signal modules (not shown) and can be mounted on a signal module. The grounding plate 174 includes a flat body section 176. The flat body section 176 includes via-engaging beams 178 extending therefrom in a direction perpendicular to the plane of the flat body section 176. The flat body section 176 also includes ground-plane engaging beams 180 extending therefrom at acute angles to the plane of the flat body section 176. The ground-plane engaging beams 180 bend away from the flat body section 176 in a direction opposite to a direction in which the via-engaging beams 178 extend.

Figure 7:
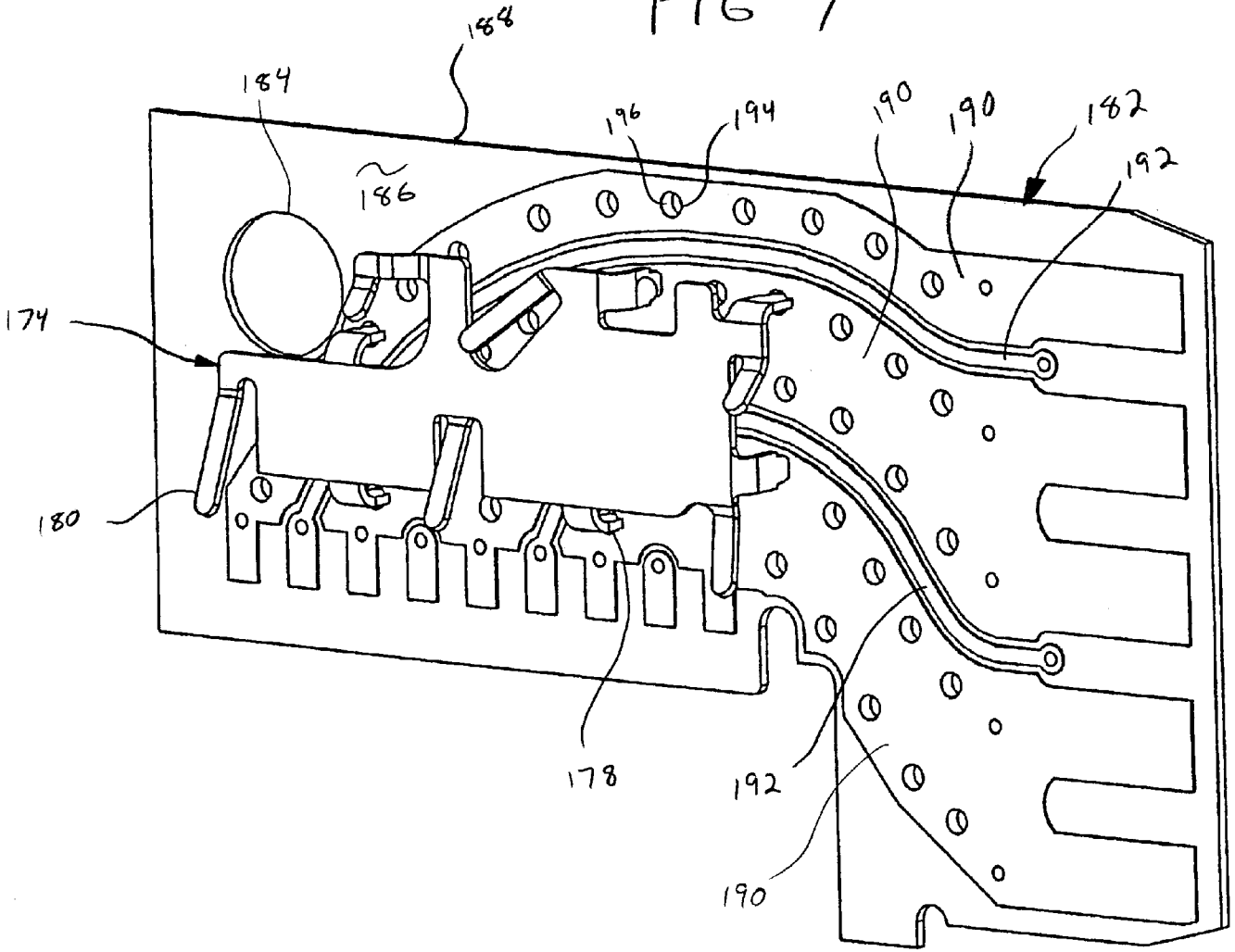
FIG. 7 illustrates a top front perspective view of the grounding plate of FIG. 6 joined with a signal module in accordance with an embodiment of the present invention.

FIG. 7 illustrates a signal module 182 with the metal plate 174 mounted thereon. The signal module 182 includes a drill hole 184 for location purposes during manufacturing. The signal module 182 also has side surfaces 186 and 188 that have ground planes 190 and signal lines 192 formed thereon. The ground planes 190 include vias 194 that extend through the signal module 182. The vias 194 have conductive liners 196 therethrough that electrically connect the ground planes 190 on the side surface 186 to the ground planes 190 on the side surface 188. The via-engaging beams 178 of the metal plate 174 are inserted into selected vias 194 on the side surface 186, thereby electrically connecting and physically attaching the metal plate 174 to the ground planes 190. Thus, all of the ground planes 190 of the signal module 182 are electrically connected to one another.

Optionally, additional metal plates 174 and signal modules 182 can be stacked into a connector housing (not shown) in an alternating arrangement so that all of the ground planes 190 of the multiple signal modules 182 are electrically interconnected with one another. In such an arrangement, the ground plane-engaging beams 180 of the metal plates 174 contact the ground planes 190 on the side surfaces 188 of the signal modules 182. The ground plane-engaging beams 180 of each of the metal plates 174 would be electrically connected, but not physically attached, to the ground planes 190 of the side surface 188, while the via-engaging beams 178 of each of the metal plates 174 would be electrically connected, and physically attached, to the ground planes 190 of the side surface 186.

Figure 8:
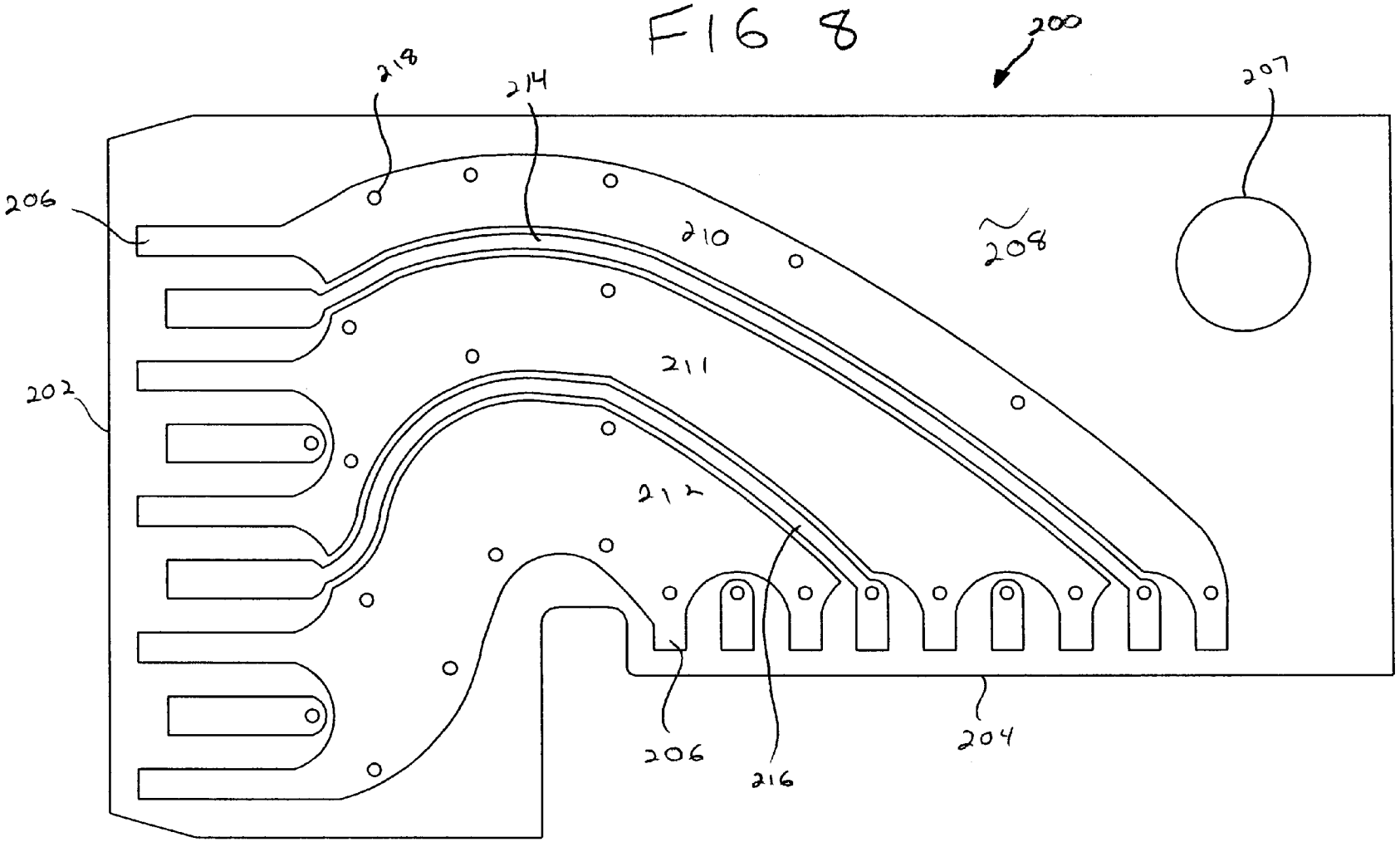
FIG. 8 illustrates a right side plan view of a signal module formed in accordance with an embodiment of the present invention

FIG. 8 illustrates a right side plan view of a signal module 200 formed in accordance with an embodiment of the present invention. The signal module 200 includes mating ends 202 and 204 that are aligned perpendicular to one another and have pads 206 for mating with contacts (not shown). The signal module 200 includes a drill hole 207 for location purposes during manufacturing. The signal module 200 also includes a side surface 208 that has ground planes 210–212 and signal lines 214 and 216. The signal line 214 is located between the ground planes 210 and 211, and the signal line 216 is located between the ground planes 211 and 212. The ground planes 210–212 include vias 218 that have conductive lining extending through the vias 218.

Figure 9:
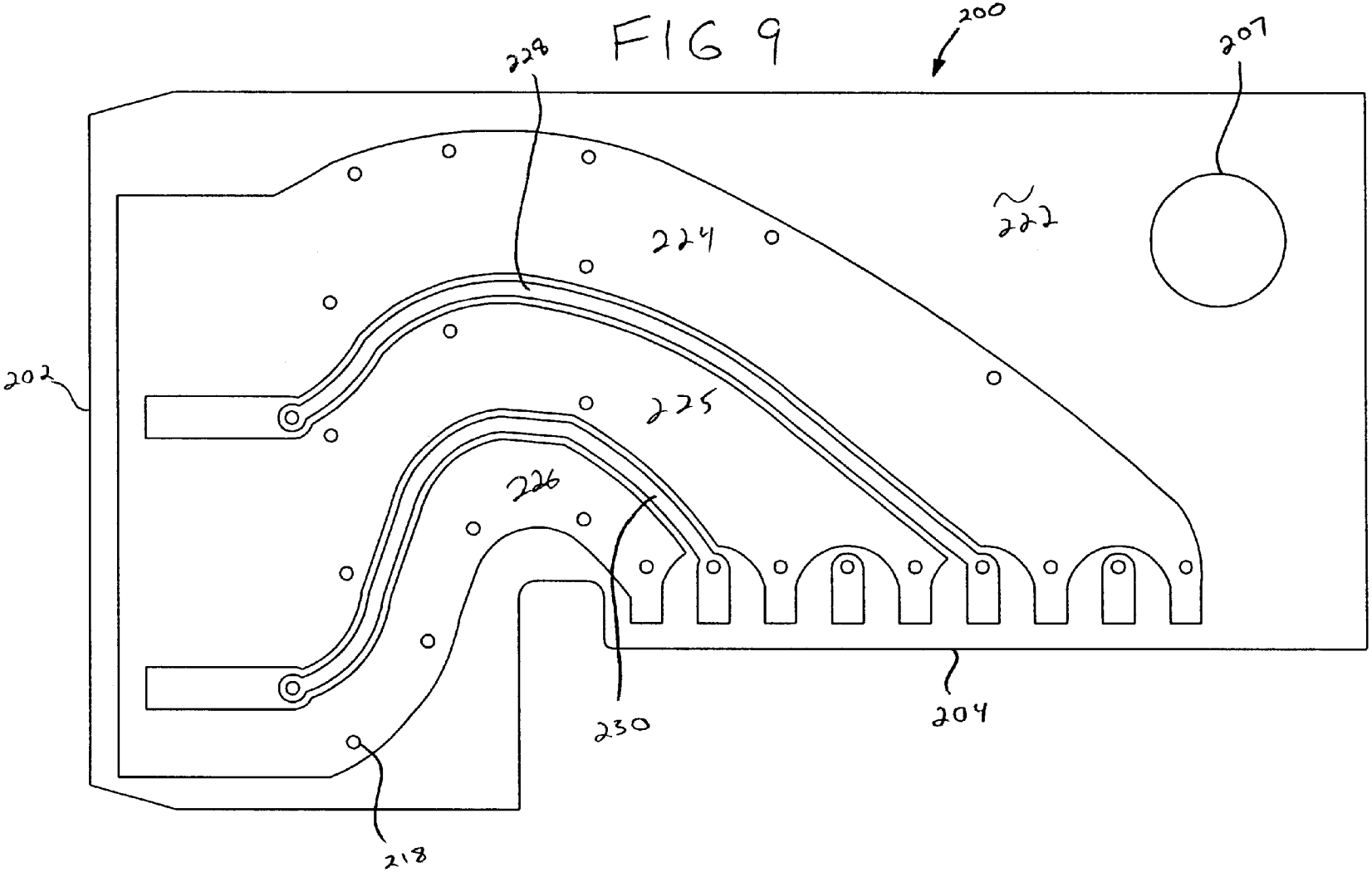
FIG. 9 illustrates a left side plan view of a signal module formed in accordance with an embodiment of the present invention.

FIG. 9 illustrates a left side plan view of the signal module 200. The signal module 200 includes a side surface 222 opposite to the side surface 208. The side surface 222 includes ground planes 224–226 and signal lines 228 and 230. The signal line 228 is located between the ground planes 224 and 225, and the signal line 230 is located between the ground planes 225 and 226. The conductive lining that extends through the vias 218 electrically connects the ground planes 210–212 of the side surface 208 to the ground planes 224–226 of the side surface 222. For example, the ground plane 210 is electrically connected to the ground plane 224, the ground plane 211 is electrically connected to the ground planes 224 and 225, and the ground plane 212 is electrically connected to the ground planes 225 and 226.

Figure 10:
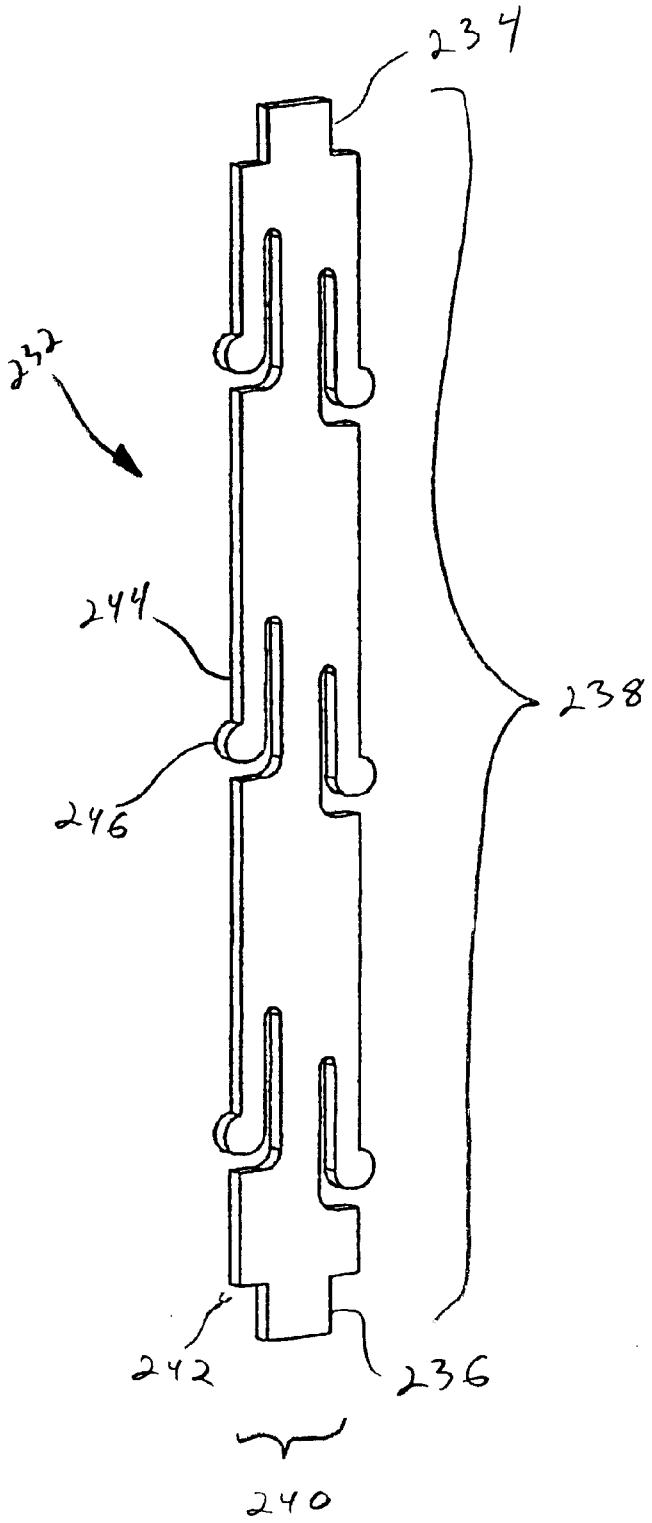
FIG. 10 illustrates a bottom front perspective view of a grounding plate formed in accordance with an embodiment of the present invention.

FIG. 10 illustrates a grounding contact 232, for insertion between signal modules 200 stacked in a parallel arrangement (not shown), formed in accordance with an embodiment of the present invention. The grounding contact 232 is a stamped strip of metal having rectangular ends 234 and 236 configured to be inserted into slots in a connector housing (not shown). The grounding contact 232 includes a height 238, width 240, and thickness 242. The grounding contact 232 includes spring elements 244 having rounded ends 246 that extend outward beyond the width 240 of the grounding contact 232. When the grounding contact 232 is installed between the signal modules 200 in a connector housing (not shown), the rounded ends 246 of the spring elements 244 engage the ground planes 210–212 and 224–226 of the signal modules 200, thereby electrically connecting the ground planes 210–212 on the side surfaces 208 of the signal modules 200 to the ground planes 224–226 on the side surfaces 222 of adjacent signal modules 200.

Figure 11:
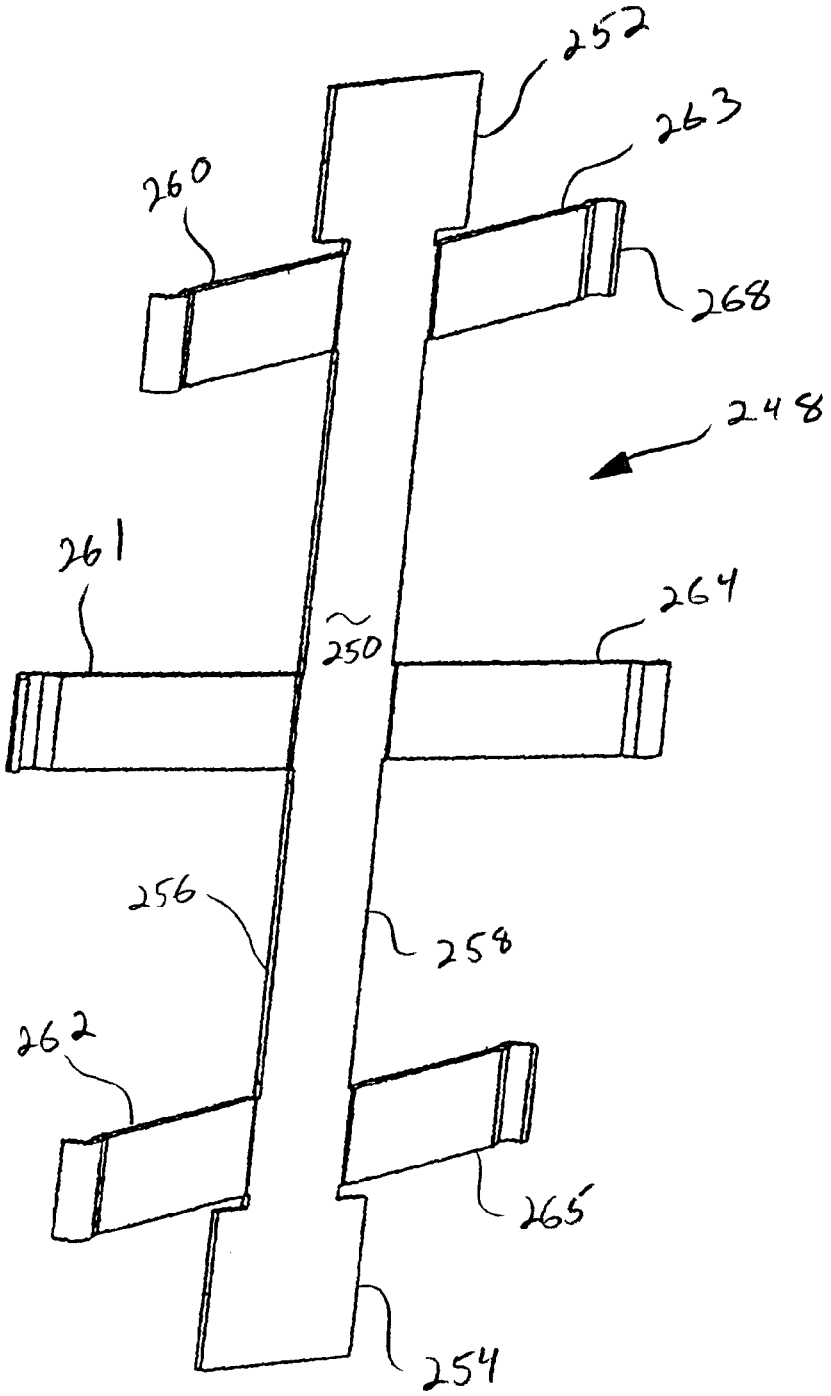
FIG. 11 illustrates a bottom front perspective view of a grounding plate formed in accordance with an embodiment of the present invention.

FIG. 11 illustrates a bottom front view of a grounding contact 248, for insertion between signal modules 200 stacked in a parallel arrangement (not shown), formed in accordance with an embodiment of the present invention. The grounding contact 248 is a stamped strip of metal having a planar body section 250 and rectangular ends 252 and 254 configured to be inserted into slots in a connector housing (not shown). The grounding contact 248 includes edges 256 and 258 extending vertically from the end 252 to the end 254. The edges 256 and 258 include compliant beams 260–265 extending outward horizontally therefrom and at angles to the planar body section 250 of the grounding contact 248. The compliant beams 260–265 include curved ends 268 for engaging the ground planes 210–212 and 224–226 of the signal modules 200. When the grounding contact 248 is installed between the signal modules 200 in a connector housing, the curved ends 268 of the compliant beams 260–265 engage the ground planes 210–212 and 224–226 of the signal modules 200, thereby electrically connecting the ground planes 210–212 on the side surfaces 208 of the signal modules 200 to the ground planes 224–226 on the side surfaces 222 of adjacent signal modules 200.

Figure 12:
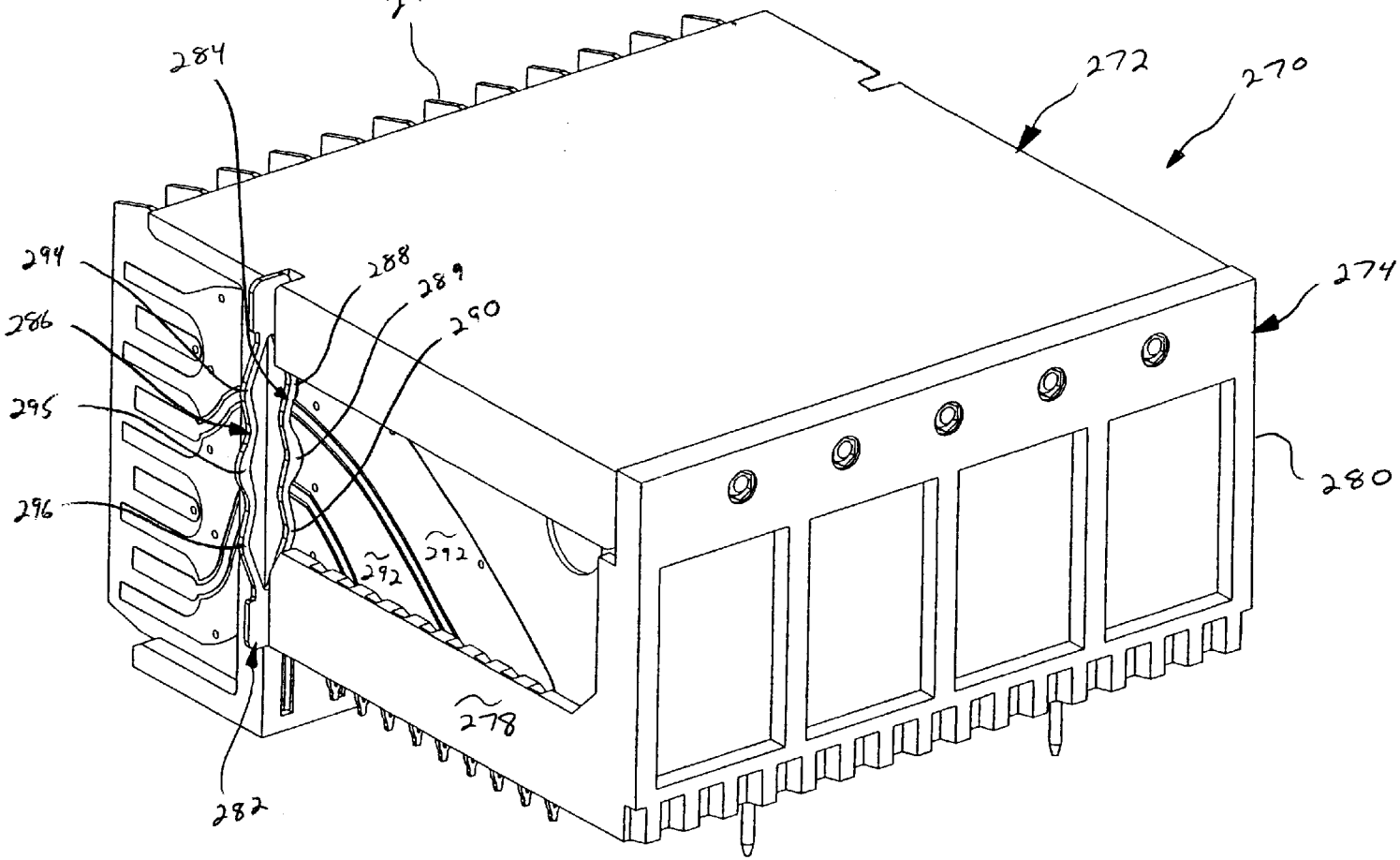
FIG. 12 illustrates a top rear perspective view of a connector assembly with an inter-connector assembly grounding clip formed in accordance with an embodiment of the resent invention.

FIG. 12 illustrates a plug 270 formed in accordance with an alternative embodiment of the present invention. The plug 270 includes mated connector housings 272 and 274 having a plurality of signal modules 276 aligned parallel to one another therein. The plug 270 includes sides 278 and 280. The side 278 includes an inter-connector assembly grounding clip 282. The grounding clip 282 includes two zigzagged bars 284 and 286. The bar 284 includes corners 288–290 protruding inward toward, and contacting, ground planes 292 on the signal module 276 that is most closely located to the side 278. The bar 286 includes corners 294–296 protruding outward away from the corners 288–290 and configured to the contact ground planes 292 on a signal module 276 in an adjacent plug 270, thereby electrically interconnecting the ground planes 292 of signal modules 276 on adjacent plugs 270.

Figure 13:
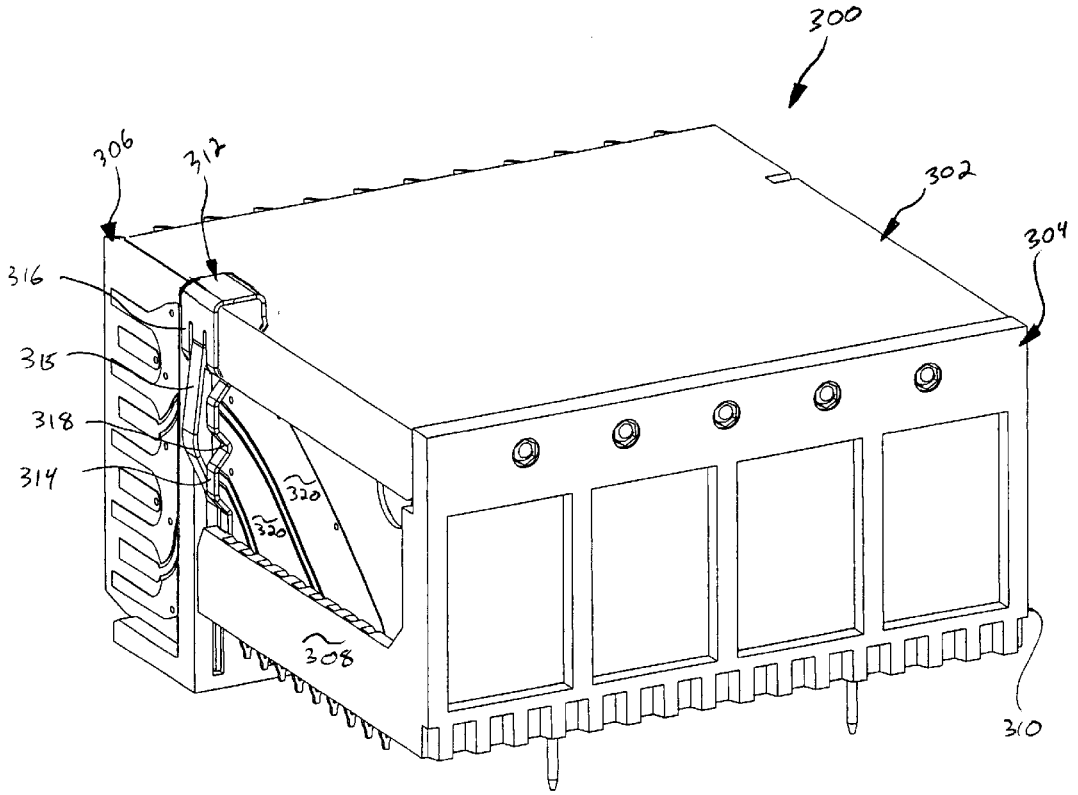
FIG. 13 illustrates a top rear perspective view of a connector assembly with an inter-connector assembly grounding clip formed in accordance with an alternative embodiment of the present invention.

FIG. 13 illustrates a plug 300 formed in accordance with an embodiment of the present invention. The plug 300 includes mated connector housings 302 and 304 having a plurality of signal modules 306 aligned parallel to one another therein. The plug 300 includes sides 308 and 310. The side 308 includes an inter-connector assembly grounding clip 312. The grounding clip 312 includes three flat beams 314–316. 316. The beams 314 and 316 include buckles 318 protruding inward toward, and contacting, the ground planes 320 on the signal module 306 that is most closely located to the side 308. The middle beam 315 is bent outward away from the connector assembly 300 and is configured to contact a middle beam 315 of a grounding clip 312 on a side 310 of an adjacent plug 300, thereby electrically interconnecting the ground planes 320 of adjacent plugs 300.

Figure 14:
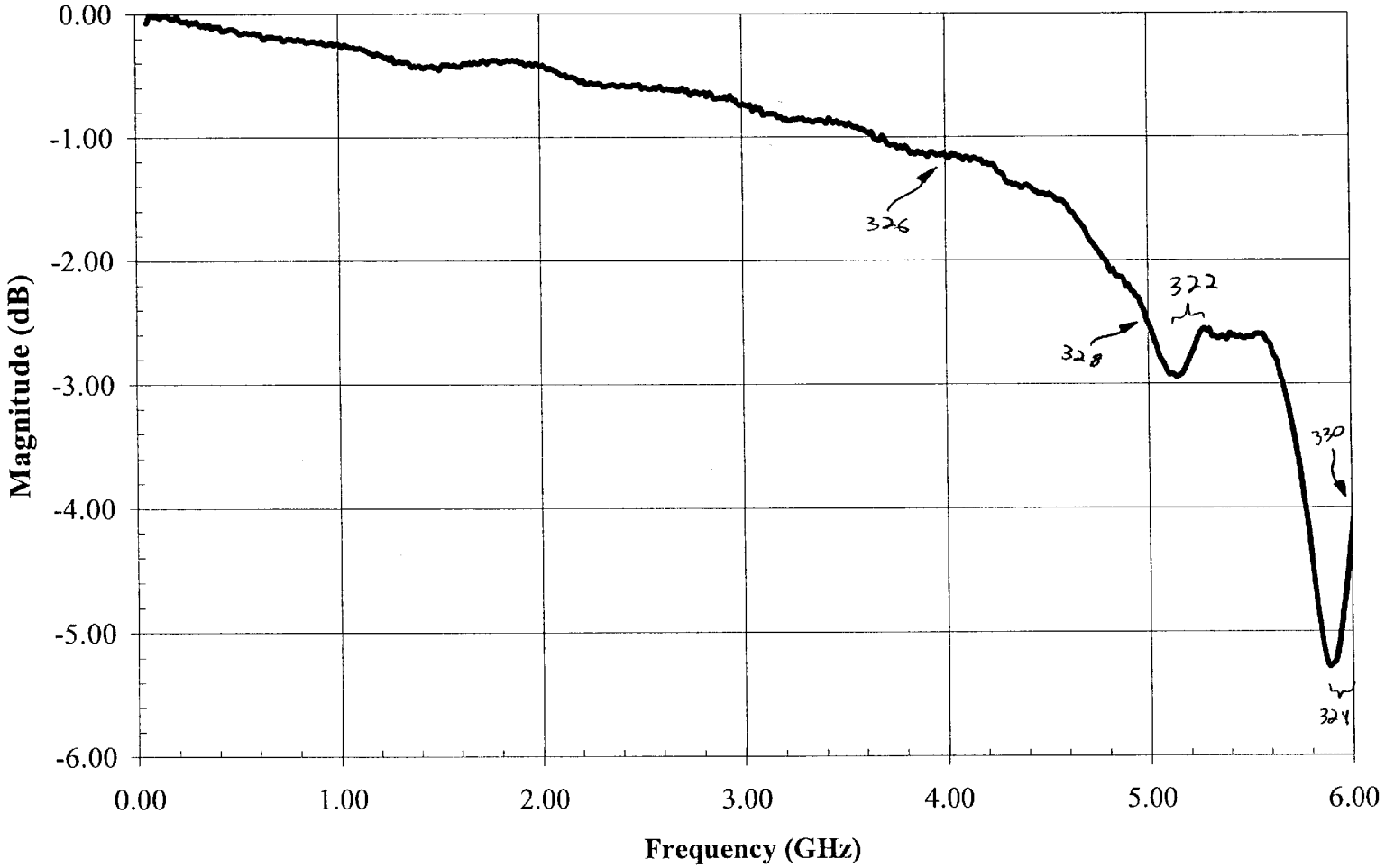
FIG. 14 illustrates a graph of insertion loss performance of a right angle connector assembly not formed in accordance with an embodiment of the present invention.

FIG. 14 illustrates a graph of insertion loss performance of a right angle connector assembly not formed in accordance with an embodiment of the present invention. The graph depicts insertion loss measured in dB along a y-axis versus fundamental frequency of a transmitted signal measured in GHz along an x-axis. The insertion loss is equal to 20 times the log base 10 of (voltage output/voltage input). Voltage input is the measure in volts of the signal input at one end of a signal line, and voltage output is the measure in volts of the signal output at an opposite end of the signal line. As the fundamental frequency increases from 0.00 to 5.00 GHz, the absolute value of insertion loss increases. As the fundamental frequency increases from 5.00 to 6.00 GHz, the absolute value of insertion loss generally increases, but along ranges 322 and 324, the absolute value of insertion loss decreases. At a fundamental frequency of 4.00 GHz, the absolute value of insertion loss is greater than 1.00 dB 326. At a fundamental frequency of 5.00 GHz, the absolute value of insertion loss is about 2.50 dB 328. At a fundamental frequency of 6.00 GHz, the absolute value of insertion loss is about 4.00 dB 330.

Figure 15:
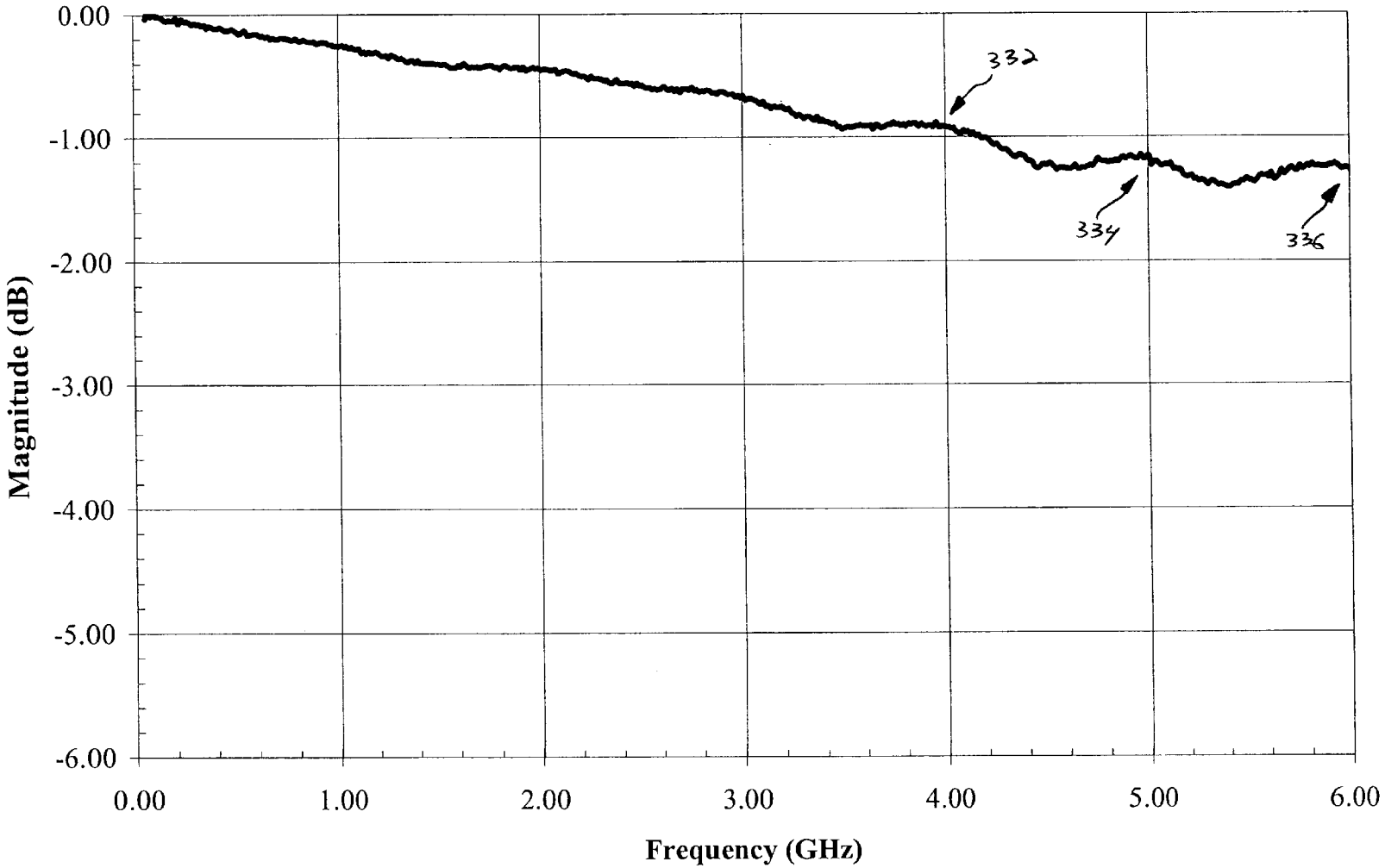
FIG. 15 illustrates a graph of insertion loss performance of a right angle connector assembly formed in accordance with an embodiment of the present invention.

FIG. 15 illustrates a graph of insertion loss performance of a right angle connector assembly formed in accordance with an embodiment of the present invention. The graph depicts insertion loss measured in dB along a y-axis versus fundamental frequency measured in GHz along an x-axis. As the fundamental frequency increases from 0.00 to 6.00 GHz, the absolute value of insertion loss increases. At a fundamental frequency of 4.00 GHz, the absolute value of insertion loss is less than 1.00 dB 332. At a fundamental frequency of 5.00 GHz, the absolute value of insertion loss is less than 1.50 dB 334. At a fundamental frequency of 6.00 GHz, the absolute value of insertion loss is still less than 1.50 dB 336.

While certain embodiments of the present invention employ plugs for right angle connector assemblies, other embodiments may include plugs for straight or orthogonal connector assemblies.

While certain embodiments of the present invention employ plugs for connector assemblies, other embodiments may include receptacles for connector assemblies.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly, comprising:

signal modules having mating ends and opposite side surfaces, at least one of said side surfaces having a signal line and a ground plane formed thereon;

a housing holding said signal modules adjacent to and spaced apart from one another; and a grounding member interconnecting said ground planes on adjacent signal modules at a grounding point along said ground planes.

2. The electrical connector assembly of claim 1, wherein said signal modules have vias therethrough, said vias having pins therethrough, said pins electrically interconnecting said ground planes on said adjacent signal modules at grounding points between said contact pads.

3. The electrical connector assembly of claim 1, wherein one of said signal modules has a via, said via electrically interconnecting ground planes on opposite sides of said one of said signal modules.

4. The electrical connector assembly of claim 1, wherein said grounding member constitutes a conductive rod extending through a plurality of said ground planes.

5. The electrical connector assembly of claim 1, wherein each of said signal modules has more than one ground plane.

6. The electrical connector assembly of claim 1, wherein said signal modules include signal lines arranged in differential pairs, each of said signal lines including first and second signal lines located on a side surface of said first and second signal modules.

7. The electrical connector assembly of claim 1, wherein said grounding member includes spring members interposed between said adjacent signal modules, each of said spring members including spring beams on opposite sides thereof, said spring beams engaging said ground planes on said adjacent signal modules.

8. The electrical connector assembly of claim 1, wherein said grounding member includes a grounding jacket having a series of slots cut therein, each of said slots receiving a corresponding signal module, each of said slots including projections that contact said ground planes.

9. The electrical connector assembly of claim 1, wherein said grounding member includes a U-shaped bracket having planar sides with dimples formed on said planar sides, said bracket being held by said housing between said signal modules in order that said dimples contact said ground planes.

10. The electrical connector assembly of claim 1, wherein said grounding member includes a plate having beams formed therein, said plate being located between adjacent signal modules, said beams contacting said ground planes on said adjacent signal modules.

11. The electrical connector assembly of claim 1, wherein said grounding member includes a plate having beams formed therein, said plate being located between adjacent signal modules, said beams being inserted into vias in ground planes on adjacent signal modules.

12. The electrical connector assembly of claim 1, wherein said grounding member includes bridging clips mounted to said housing between adjacent signal modules, each of said bridging clips including arms contacting said adjacent signal modules.

13. The electrical connector assembly of claim 1, wherein said grounding member includes plates fastened to said housing between said adjacent signal modules, each of said plates including beams contacting said adjacent signal modules.

14. The electrical connector assembly of claim 1, wherein said ground planes include contact pads formed at opposite ends of said ground planes, said contact pads being located proximate said mating ends of said signal modules.

15. An electrical connector assembly, comprising:

signal modules having opposite side surfaces and mating ends, at least one of said side surfaces having a signal line and a ground plane formed thereon;

a housing holding said signal modules adjacent to and spaced apart from one another; and means for interconnecting said ground planes on adjacent signal modules at a grounding point along said ground planes.

16. The electrical connector assembly of claim 14, wherein said interconnecting means includes a conductive rod extending through a plurality of said ground planes.

17. The electrical connector assembly of claim 14, wherein said interconnecting means includes spring members interposed between said adjacent signal modules, each of said spring members including spring beams on opposite sides thereof, said spring beams engaging said ground planes on said adjacent signal modules.

18. The electrical connector assembly of claim 14, wherein said interconnecting means includes a grounding jacket having a series of slots cut therein, each of said slots receiving a corresponding signal module, each of said slots including projections that contact said ground planes.

19. The electrical connector assembly of claim 14, wherein said interconnecting means includes a U-shaped bracket having planar sides with dimples formed on said planar sides, said bracket being held by said housing between said signal modules in order that said dimples contact said ground planes.

20. The electrical connector assembly of claim 14, wherein said interconnecting means includes a plate having beams formed therein, said plate being located between adjacent signal modules, said beams contacting said ground planes on said adjacent signal modules.

* * * * *